US006098208A

United States Patent [19]

Cordon

[11] Patent Number: 6,098,208

[45] Date of Patent: Aug. 8, 2000

[54] PROTECTIVE PADS FOR BASEBALL PLAYERS

[76] Inventor: Jeffrey D. Cordon, 17 Pearl St., Randolph, Mass. 02368

[21] Appl. No.: 09/426,152

[22] Filed: Oct. 22, 1999

[51] Int. Cl.[7] ..... A41D 13/00

[52] U.S. Cl. ..... 2/455; 2/16; 2/22; 2/465

[58] Field of Search ..... 2/16, 22, 24, 61, 2/62, 69, 242, 455, 456, 462, 463, 467, 464, 465, 267, 268, 908; 128/878, 881, 882; 602/20, 23, 26, 27, 62, 65

[56] References Cited

U.S. PATENT DOCUMENTS

| | | | |
|---|---|---|---|
| D. 328,961 | 8/1992 | Hodder et al. | D29/10 |
| 689,837 | 12/1901 | Whitney | 2/455 |
| 909,215 | 1/1909 | Pierce et al. | 2/455 |
| 1,229,947 | 6/1917 | Haggerty | 2/465 |
| 3,801,984 | 4/1974 | Kanicki | 2/455 |
| 3,991,420 | 11/1976 | Savarino | 2/455 |
| 4,370,754 | 2/1983 | Donzis | 2/455 |
| 4,441,211 | 4/1984 | Donzis | 2/455 |
| 4,481,679 | 11/1984 | Hayes | 2/455 |
| 4,608,716 | 9/1986 | Brumfield | 2/2.5 |
| 4,608,718 | 9/1986 | Reed | 2/22 |
| 5,029,341 | 7/1991 | Wingo | 2/455 |
| 5,052,052 | 10/1991 | Gilford et al. | 2/455 |
| 5,452,475 | 9/1995 | Hunt | 2/22 |
| 5,611,080 | 3/1997 | Skottheim | 2/16 |
| 5,634,211 | 6/1997 | Chen | 2/22 |
| 5,669,080 | 9/1997 | Culton | 2/455 |
| 5,742,938 | 4/1998 | Winningham et al. | 2/22 |

*Primary Examiner*—Gloria M. Hale
*Assistant Examiner*—Tejash Patel

[57] ABSTRACT

Protective pads for baseball players for protecting arms, hips, ribs and calves. The protective pads for baseball players include an arm guard for protecting an elbow and forearm of a user. The arm guard comprises a first domed member and a second domed member attached to a cloth is adapted for wrapping around an arm. The cloth has a fastening system thereon for binding the cloth around the user's arm. A rib guard protects a rib area of a user. The rib guard comprises a generally rectangular cloth adapted to fit around a chest an upper torso of a user having two protective shields on a side area of the user. The cloth has a fastening system thereon for binding the cloth around the user's chest. A hip guard protects a hip and thigh area of a user. The hip guard comprises a cloth adapted to wrap around a user's leg. The cloth has a fastening system thereon for binding the cloth around the user's thigh area. A third and fourth domed member, and a plurality of devices adapted to fasten the cloth to the domed members. A calf guard for protecting a calf area of a user. The calf guard comprises a generally rectangular piece of cloth adapted to fit around a user's calf. The cloth has a fastening system thereon for binding the cloth around the user's calf. A fifth domed member and plurality of devices for fastening the fifth domed member to the cloth.

10 Claims, 3 Drawing Sheets

PROTECTIVE PADS FOR BASEBALL PLAYERS

BACKGROUND OF THE INVENTION

1. Field of the Invention

The present invention relates to protective pads and more particularly pertains to new protective pads for baseball players for protecting arms, lips, ribs and calves.

2. Description of the Prior Art

The use of protective pads is known in the prior art. More specifically, protective pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,608,718; U.S. Pat. No. 3,991,420; U.S. Pat. No. 3,801,984; U.S. Pat. No. 5,669,080; U.S. Pat. No. 5,742,938: and U.S. Pat. Des. No. 328,961.

While these devices fulfill their respective, particular objectives and requirements, the aforementioned patents do not disclose new protective pads for baseball players. The inventive device includes an arm guard for protecting an elbow and forearm of a user. The arm guard comprises a first domed member and a second domed member. A cloth is adapted for wrapping around an arm. The cloth comprises a distal portion for wrapping around a user's arm between the user's elbow and biceps and a proximal portion for wrapping around a user's forearm. A central portion couples the distal portion of the cloth to the proximal portion of the cloth. The distal portion and the proximal portion have a fastening system thereon for binding the cloth around the user's arm. A plurality of devices fasten the domed members to the cloth. A rib guard protects a rib area of a user. The rib guard comprises a generally rectangular cloth adapted to fit around a chest an upper torso of a user such that the lower ribs of a user are covered. The cloth has a fastening system thereon for binding the cloth around the user's chest. Two protective shields are on a side area of the user adjacent to the user's lower ribs, and a plurality of devices fasten each of the shields to the rectangular cloth. A hip guard protects a hip and thigh area of a user. The hip guard comprises a cloth adapted to wrap around a user's leg. The cloth has a fastening system thereon for binding the cloth around the user's thigh area. A third and fourth domed member, and a plurality of devices adapted to fasten the cloth to the domed members. A calf guard for protecting a calf area of a user. The calf guard comprises a generally rectangular piece of cloth adapted to fit around a user's calf. The cloth has a fastening system thereon for binding the cloth around the user's calf. A fifth domed member and plurality of devices for fastening the fifth domed member to the cloth.

In these respects, the protective pads for baseball players according to the present invention substantially departs from the conventional concepts and designs of the prior art, and in so doing provides an apparatus primarily developed for the purpose of protecting arms, hips, ribs and calves.

SUMMARY OF THE INVENTION

In view of the foregoing disadvantages inherent in the known types of protective pads now present in the prior art, the present invention provides a new protective pads for baseball players construction wherein the same can be utilized for protecting arms, hips, ribs and calves.

The general purpose of the present invention, which will be described subsequently in greater detail, is to provide new protective pads for baseball players apparatus and method which has many of the advantages of the protective pads mentioned heretofore and many novel features that result in a new protective pads for baseball players which is not anticipated, rendered obvious, suggested, or even implied by any of the prior art protective pads, either alone or in any combination thereof.

To attain this, the present invention generally comprises an arm guard for protecting an elbow and forearm of a user. The arm guard comprises a first domed member and a second domed member. A cloth is adapted for wrapping around an arm. The cloth comprises a distal portion for wrapping around a user's arm between the user's elbow and biceps and a proximal portion for wrapping around a user's forearm. A central portion couples the distal portion of the cloth to the proximal portion of the cloth. The distal portion and the proximal portion have a fastening system thereon for binding the cloth around the user's arm. A plurality of devices fasten the domed members to the cloth. A rib guard protects a rib area of a user. The rib guard comprises a generally rectangular cloth adapted to fit around a chest an upper torso of a user such that the lower ribs of a user are covered. The cloth has a fastening system thereon for binding the cloth around the user's chest. Two protective shields are on a side area of the user adjacent to the user's lower ribs, and a plurality of devices fasten each of the shields to the rectangular cloth. A hip guard protects a hip and thigh area of a user. The hip guard comprises a cloth adapted to wrap around a user's leg. The cloth has a fastening system thereon for binding the cloth around the user's thigh area. A third and fourth domed member, and a plurality of devices adapted to fasten the cloth to the domed members. A calf guard for protecting a calf area of a user. The calf guard comprises a generally rectangular piece of cloth adapted to fit around a user's calf. The cloth has a fastening system thereon for binding the cloth around the user's calf. A fifth domed member and plurality of devices for fastening the fifth domed member to the cloth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new protective pad apparatus and method for baseball players which has many of the advantages of the protective pads mentioned heretofore and many novel features that result in a new protective pads for baseball players which is not anticipated, rendered obvious, suggested, or even implied by any of the prior art protective pads, either alone or in any combination thereof.

It is another object of the present invention to provide new protective pads for baseball players which may be easily and efficiently manufactured and marketed.

It is a further object of the present invention to provide new protective pads for baseball players which is of a durable and reliable construction.

An even further object of the present invention is to provide new protective pads for baseball players which is susceptible of a low cost of manufacture with regard to both materials and labor, and which accordingly is then susceptible of low prices of sale to the consuming public, thereby making such protective pads for baseball players economically available to the buying public.

Still yet another object of the present invention is to provide new protective pads for baseball players which provides in the apparatuses and methods of the prior art some of the advantages thereof, while simultaneously overcoming some of the disadvantages normally associated therewith.

Still another object of the present invention is to provide new protective pads for baseball players for protecting arms, hips, ribs and calves.

Yet another object of the present invention is to provide a new protective pads for baseball players which includes an arm guard for protecting an elbow and forearm of a user. The arm guard comprises a first domed member and a second domed member. A cloth is adapted for wrapping around an arm. The cloth comprises a distal portion for wrapping around a user's arm between the user's elbow and biceps and a proximal portion for wrapping around a user's forearm. A central portion couples the distal portion of the cloth to the proximal portion of the cloth. The distal portion and the proximal portion have a fastening system thereon for binding the cloth around the user's arm. A plurality of devices fasten the domed members to the cloth. A rib guard protects a rib area of a user. The rib guard comprises a generally rectangular cloth adapted to fit around a chest an upper torso of a user such that the lower ribs of a user are covered. The cloth has a fastening system thereon for binding the cloth around the user's chest. Two protective shields are on a side area of the user adjacent to the user's lower ribs, and a plurality of devices fasten each of the shields to the rectangular cloth. A hip guard protects a hip and thigh area of a user. The hip guard comprises a cloth adapted to wrap around a user's leg. The cloth has a fastening system thereon for binding the cloth around the user's thigh area. A third and fourth domed member, and a plurality of devices adapted to fasten the cloth to the domed members. A calf guard for protecting a calf area of a user. The calf guard comprises a generally rectangular piece of cloth adapted to fit around a user's calf. The cloth has a fastening system thereon for binding the cloth around the user's calf. A fifth domed member and plurality of devices for fastening the fifth domed member to the cloth.

Still yet another object of the present invention is to provide a new protective pads for baseball players that has rigid shielding which can be removed from the rest of the pad apparatus by a snapping means.

Even still another object of the present invention is to provide a new protective pads for baseball players that will protect a large portion of a batter's body.

These together with other objects of the invention, along with the various features of novelty which characterize the invention, are pointed out with particularity in the claims annexed to and forming, a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
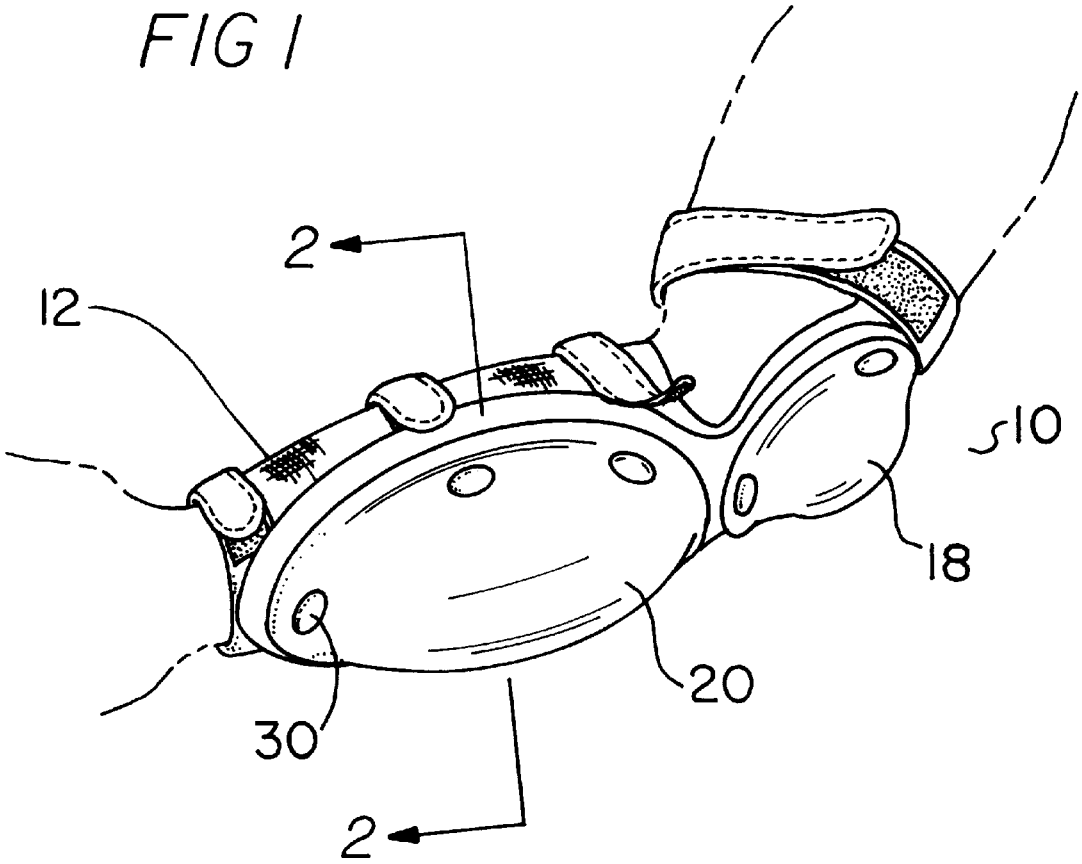
FIG. 1 is a schematic perspective view of a new protective pads for baseball players according to the present invention.
Figure 2:
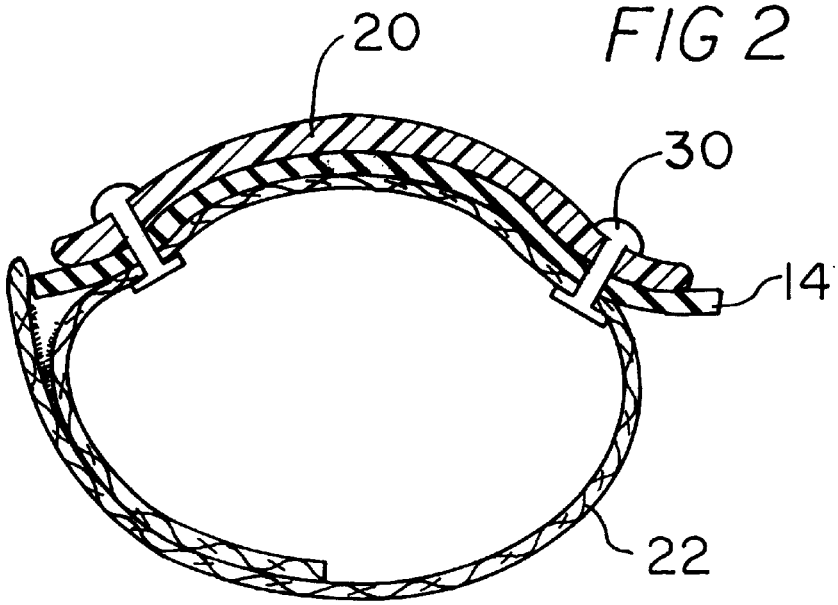
FIG. 2 is a schematic cross-sectional view of the present invention.

With reference now to the drawings, and in particular to FIGS. 1 through 7 thereof, a new protective pads for baseball players embodying the principles and concepts of the present invention and generally designated by the reference numeral 10 will be described.

As best illustrated in FIGS. 1 through 7, the protective pads for baseball players 10 generally comprise a system of pads. The pads include an arm guard 12, rib pads 40, hip and thigh pads 55, and a calf pad 70.

Figure 3:
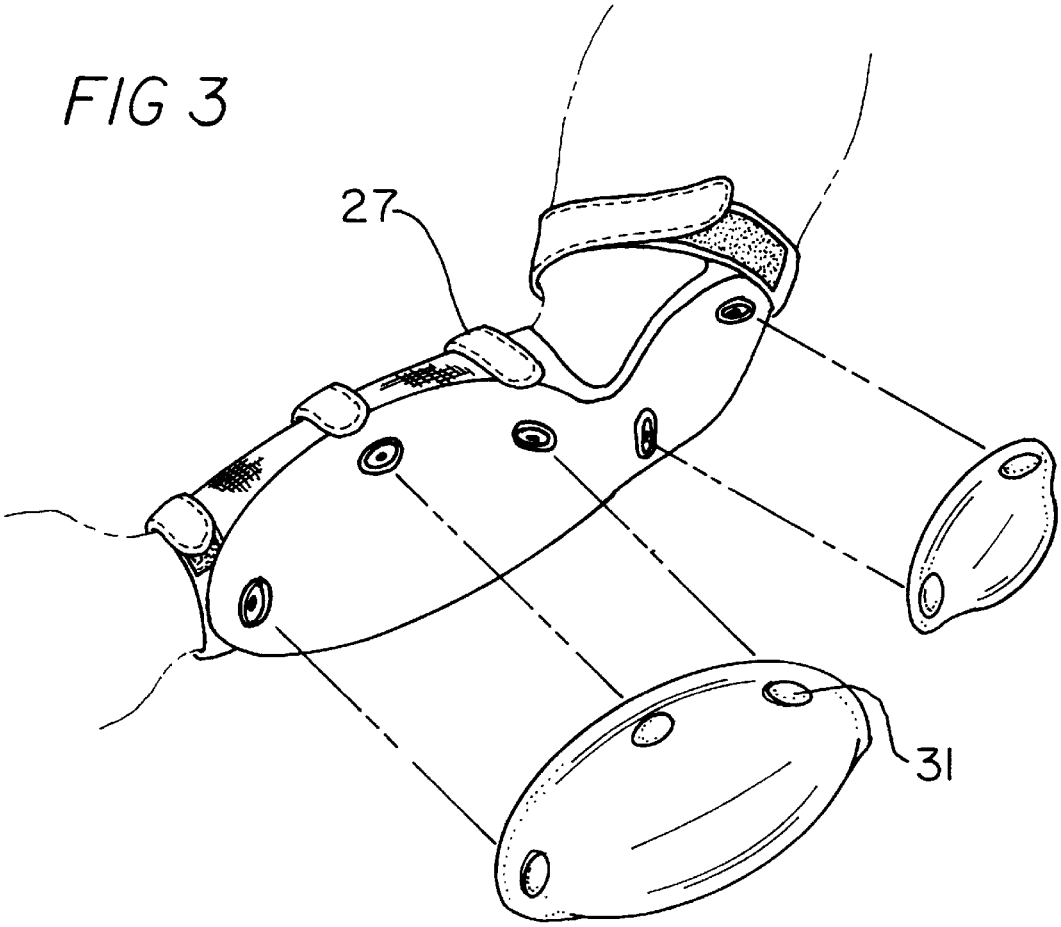
FIG. 3 is a schematic perspective view a second embodiment of the present invention.
Figure 4:
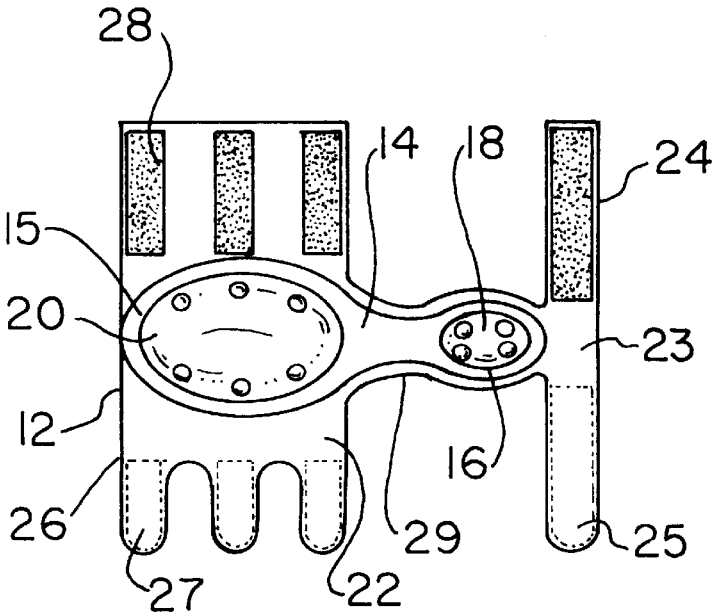
FIG. 4 is a schematic plan view of the present invention.
Figure 5:
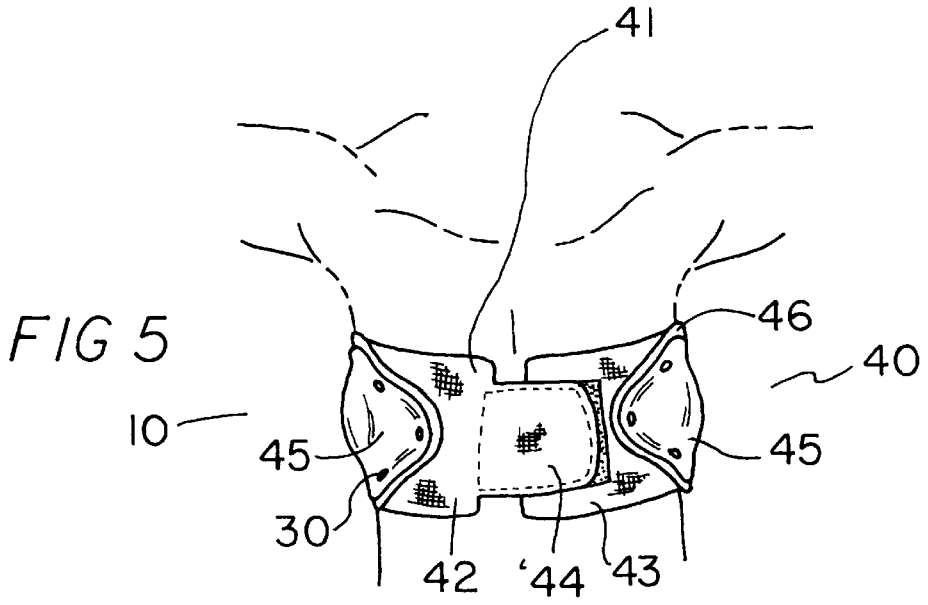
FIG. 5 is a schematic perspective view of the present invention.
Figure 6:
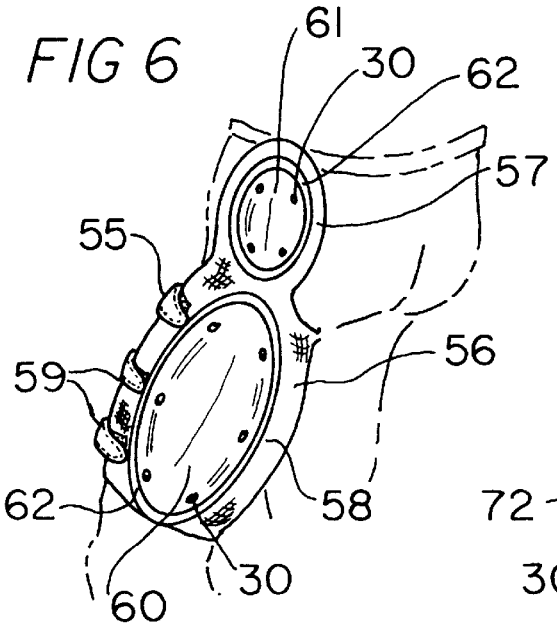
FIG. 6 is a schematic perspective view of the present invention.
Figure 7:
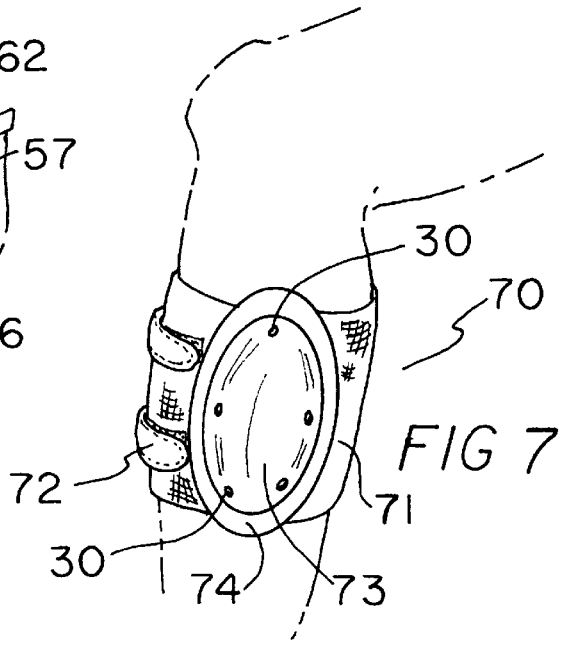
FIG. 7 is a schematic perspective view of the present invention.

The arm guard 12 is for protecting an elbow and forearm of a user. The arm guard comprises an elongate strip 14. Preferably, the strip is comprised of elastomeric material. The strip has a generally figure-8 peripheral shape with an edge, wherein a top half 15 of the figure-8 peripheral shape is smaller than a bottom half of the figure-8 16 peripheral shape. A first domed member 18 and a second domed member 20 wherein the first domed member is smaller than the second domed member is. The first and second domed members preferably comprise a rigid plastic. A cloth 22 is adapted for wrapping around an arm. The cloth has a distal portion 23 for wrapping around a users arm between the user's elbow and biceps. The distal portion is an elongate strip having a first half section 24 and a second half section 25. A fastening system is used to bind the first half to the second half section. Preferably, the first half section has a top surface has a hook and loop structure thereon and the second half section has a bottom surface and has a hook and loop means thereon. A proximal portion 26 is for wrapping around a user's forearm. The proximal portion of the cloth is generally rectangular and has a width larger than a height of the bottom half 15 of the figure-8 peripheral shape. The proximal portion has a top edge and a bottom edge. Preferably, the bottom edge of the cloth has three elongate cloth members 27 extending therefrom. The elongate members of the proximal portion have a bottom surface having a hook and loop fastening structure attached thereto. The top surface 28 of the proximal portion has a hook and loop fastening structure attached thereto adjacent to the top edge. Wrapping the proximal portion 26 around a forearm of user brings the elongate members 27 in contact with the hook and loop structure on the surface 28 of the proximal portion. A central portion 29 couples the distal portion of the cloth to the proximal portion of the cloth. Preferably a plurality of rivets 30 fasten the strip between the cloth and the domed members, wherein the first domed member 18 is coupled to the top half of the figure-8 peripheral shape of the strip and wherein the second domed member 20 is coupled to the bottom half of the figure-8 peripheral shape of the strip. Other fastening systems besides rivets may be used and snaps 31 are shown in FIG. 3. The bottom half 15 of the figure-8 peripheral shape of the strip is positioned over the proximal portion 26 of the cloth and the top half 16 of the figure-8 peripheral shape of the strip is positioned over the central portion 29 of the cloth.

A rib guard 40 protects the rib area of a user. The rib guard comprises a generally rectangular cloth 41 adapted to fit around a chest an upper torso of a user such that the lower ribs of a user are covered. The cloth has an upper surface 42 and a bottom surface, not shown, a first end 43 and a second end 44. The upper surface 42 of the first end 43 has a hook and loop fastening structure thereon, and the bottom surface of the second end 44 has a hook and loop fastening structure thereon. The cloth is wrapped around the torso of a user such that the top surface of the first end is covered by the bottom surface of the second end such that the ends are removably fastened together. Two protective shields 45 are preferably contoured to fit on a side area of the user adjacent to the user's lower ribs such that each of the shields is bowed outwardly away from the ribs. Two padded portions 46 each have a perimeter size larger than one of the protective shields 45. The padded portions preferably comprise elastomeric material. A plurality of rivets 30 hold each of the shields to the rectangular cloth, wherein each of the padded portions is situated between one of the shields 45 and the rectangular cloth 41. The rivets are positioned at spaced locations along and adjacent to a perimeter of each of the protective shields.

A hip guard 55 protects the hip and thigh area of a user, the hip guard comprises a cloth 56 adapted to wrap around a user's leg. The cloth has a circular portion 57 and a rectangular portion 58. The rectangular portion 58 has a first edge and a second edge. Preferably, the first edge has three elongate cloth members 59 extending therefrom. The elongate members have a bottom surface having a hook and loop structure affixed thereto. The second edge of the cloth has a hook and loop means affixed to an upper surface thereof, wherein placing each of the elongate members of the cloth over the second edge of cloth fastens the cloth to the user's leg. A third domed member 60 and a fourth domed member 61 are employed. Preferably, a perimeter size of the fourth doomed member 61 is smaller than a perimeter size of the third domed member 60. Two padded portions 62 have a perimeter larger than the third and fourth domed members do. Preferably, the padded portions comprising elastomeric material. Preferably, a plurality of rivets 30 fasten the strip between the cloth and the domed members, wherein the third domed member is coupled to the rectangular portion of the cloth and wherein the fourth domed member is coupled to the circular portion of the cloth. The rivets are positioned at spaced locations along and adjacent to a perimeter of each of the third and fourth domed members.

A calf guard 70 protects a calf area of a user and comprises a generally rectangular piece of cloth 71 adapted to fit around a user's calf. The cloth has a first edge and a second edge. Preferably, the first edge of cloth has two elongate members 72 extending therefrom. The elongate members have a bottom surface has a hook and loop structure thereon. The second edge has a top surface having a hook and loop structure thereon, wherein placing the elongate members of the first edge over the second edge fastens the cloth to the user's calf. A fifth domed member 73 is used. A padded portion 74 has a perimeter larger than the fifth domed member 73, and preferably the padded portion is comprised of elastomeric material. A plurality of rivets 30 fastens the fifth domed member 73 to the cloth 71 such that the padded portion 74 is between the fifth doomed member and the cloth. The rivets arc positioned at spaced locations along and adjacent to a perimeter of the fifth dome.

In use, each of the guards is placed over the correct body part for which it was designed. The cloth is wrapped around the body part and secured to the body by the hook and loop fastening means which will attach one part of the cloth to a second part of the cloth. In a second embodiment, the rivets are replaced with snaps which allow the rigid guards to be removed without removing the entire apparatus.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protection system for protecting a batter from injury by impact from a baseball, said protection system comprising essentially in combination:

an arm guard for protecting an elbow and forearm of a user, said arm guard comprising:

a first domed member and a second domed member;

a cloth being adapted for wrapping around an elbow and forearm, said cloth comprising:

a distal portion for wrapping around the users arm between the user's elbow and biceps;

a proximal portion for wrapping around the users forearm; and a central portion for coupling said distal portion of said cloth to said proximal portion of said cloth;

wherein said distal portion and said proximal portion have a fastening system thereon for binding said cloth around the user's arm;

a plurality of fastening means for connecting said domed members to said cloth;

a rib guard for protecting a rib area of a user, said rib guard comprising:

a generally rectangular cloth adapted to fit around a chest an upper torso of the user such that the lower ribs of the user are covered, wherein said cloth has a fastening system thereon for binding said cloth around the user's chest;

two protective shields, each of said shields being on a side area of said user adjacent to said user's lower ribs;

a plurality of fastening means for connecting each of said shields to said rectangular cloth;

a hip guard for protecting a hip and thigh area of the user, said hip guard comprising:

a cloth adapted to wrap around the user's leg, wherein said cloth has a fastening system thereon for binding said cloth around the user's thigh area;

a third domed member;

a fourth domed member;

a plurality of fastening means for connecting said cloth to said third and fourth domed members;

a calf guard for protecting a calf area of the user, said calf guard comprising:

a generally rectangular piece of cloth adapted to fit around the user's calf, wherein said cloth has a fastening system thereon for binding said cloth around said the user's calf;

a fifth domed member; and a plurality of fastening means for connecting said fifth domed member to said cloth.

2. The protection system for protecting a batter from injury by impact from a baseball as in claim 1, wherein said devices are snaps.

3. The protection system for protecting a batter from injury by impact from a baseball as in claim 1, wherein said devices are rivets.

4. The protection system for protecting a batter from injury by impact from a baseball as in claim 1, wherein said fastening systems are a hook and loop structure.

5. A protection system for protecting a batter from injury by impact from a baseball as in claim 1, said protection system further comprising:

an elastomeric material within said arm guard, said elastomeric material being between said cloth and said domed members.

6. The protection system for protecting a batter from injury by impact from a baseball as in claim 1, wherein said rib guard further includes:

two padded portions each having, a perimeter size larger than one of said protective shields, each of said padded portions comprising elastomeric material, wherein said padded portions are between each of said shields and said cloth.

7. The protection system for protecting a batter from injury by impact from a baseball as in claim 1, wherein said hip guard further includes two padded portions having a perimeter larger than said third and fourth domed member, each of said padded portions comprising elastomeric material.

8. The protection system for protecting a batter from injury by impact from a baseball as in claim 1, wherein said calf guard further includes a padded portion having a perimeter larger than said fifth domed member, said padded portion comprising elastomeric material.

9. A protection system for protecting a batter from injury by impact from a baseball, said protection system comprising essentially in combination:

an arm guard for protecting an elbow and forearm of a user, said arm guard comprising:

an elongate strip, said strip comprising elastomeric material;

a first domed member and a second domed member, said first and second domed members comprising a rigid plastic;

a cloth being adapted for wrapping around an elbow and forearm, said cloth comprising:

a distal portion for wrapping around a users arm between the user's elbow and biceps, said distal portion being an elongate strip, said strip having a first half section and a second half section, said first half section having a top surface having a hook and loop structure thereon, said second half section having a bottom surface having a hook and loop means thereon;

a proximal portion for wrapping around the users forearm, said proximal portion of said cloth being generally rectangular having a width larger than a height of said bottom half of said figure-8 peripheral shape, said proximal portion having a top edge and a bottom edge, said bottom edge of said cloth having at least one cloth elongate member extending therefrom, said elongate member of said proximal portion having a bottom surface having a hook and loop fastening structure attached thereto, said top surface of said proximal portion having a hook and loop fastening structure attached thereto adjacent to said top edge such that wrapping said proximal portion around the forearm of user brings said elongate member in contact with the hook and loop structure on said surface of said proximal portion; and a central portion for coupling said distal portion of said cloth to said proximal portion of said cloth;

a plurality of rivets fastening said strip between said cloth and said domed members;

a rib guard for protecting a rib area of the user, said rib guard comprising:

a generally rectangular cloth adapted to fit around a chest an upper torso of the user such that the lower ribs of the user are covered, said cloth having an upper surface and a bottom surface, said cloth having a first end and a second end, said upper surface of said first end having a hook and loop fastening structure thereon, said bottom surface of said second end having a hook and loop fastening structure thereon, wherein said cloth is wrapped around the torso of the user and top surface of the first end is covered by the bottom surface of the second end such that said ends are removably fastened together;

two protective shields, each of said shields being contoured to fit on a side area of said user adjacent to said user's lower ribs;

two padded portions each having a perimeter size larger than one of said protective shields, each of said padded portions comprising elastomeric material; and a plurality of rivets for holding each of said shields to said rectangular cloth;

a hip guard for protecting a hip and thigh area of the user, said hip guard comprising:

a cloth adapted to wrap around the user's leg, said cloth having a circular portion and a rectangular portion, said rectangular portion having a first edge and a second edge, said first edge having a plurality of elongate cloth members extending therefrom, said elongate members having a bottom surface having a hook and loop structure affixed thereto, said second edge of said cloth having a hook and loop means affixed to an upper surface thereof, wherein placing each of the elongate members of the cloth over the second edge of cloth fastens said cloth to the user's leg;

a third domed member;

a fourth domed member, wherein a perimeter size of said fourth doomed member is smaller than a perimeter size third domed member;

two padded portions having a perimeter larger than said third and fourth domed member, each of said padded portions comprising elastomeric material; and a plurality of rivets adapted to fasten said strip between said cloth and said domed members;

a calf guard for protecting a calf area of the user, said calf guard comprising:

a generally rectangular piece of cloth adapted to fit around the user's calf, said cloth having a first edge and a second edge, said first edge of cloth having at least one elongate member extending therefrom, said elongate member having a bottom surface having a hook and loop structure thereon, said second edge having a top surface having a hook and loop structure thereon, wherein placing said elongate member of said first edge over said second edge fastens said cloth to the user's calf;

a fifth domed member;

a padded portion having a perimeter larger than said fifth domed member, said padded portion comprising elastomeric material; and a plurality of rivets for fastening said fifth domed member to said cloth such that said padded portion is between said fifth doomed member and said cloth.

10. A protection system for protecting a batter from injury by impact from a baseball, said protection system comprising essentially in combination:

an arm guard for protecting an elbow and forearm of a user, said arm guard comprising:

an elongate strip, said strip comprising elastomeric material, said strip having a generally figure-8 peripheral shape with an edges wherein a top half of said figure-8 peripheral shape is smaller than a bottom half of said figure-8 peripheral shape;

a first domed member and a second domed member, said first domed member being smaller than said second domed member, said first and second domed members comprising a rigid plastic;

a cloth being adapted for wrapping around an elbow and forearm, said cloth comprising:

a distal portion for wrapping around a users arm between the user's elbow and biceps, said distal portion being an elongate strip, said strip having a first half section and a second half section, said first half section having a top surface having a hook and loop structure thereon, said second half section having a bottom surface having a hook and loop means thereon;

a proximal portion for wrapping around the users forearm, said proximal portion of said cloth being generally rectangular having a width larger than a height of said bottom half of said figure-8 peripheral shape, said proximal portion having a top edge and a bottom edge said bottom edge of said cloth having three elongate cloth members extending therefrom, said elongate members of said proximal portion having a bottom surface having a hook and loop fastening structure attached thereto, said top surface of said proximal portion having a hook and loop fastening structure attached thereto adjacent to said top edge such that wrapping said proximal portion around the forearm of user brings said elongate members in contact with the hook and loop structure on said surface of said proximal portion; and a central portion for coupling said distal portion of said cloth to said proximal portion of said cloth;

a plurality of rivets fastening said strip between said cloth and said domed members, wherein said first domed member is coupled to said top half of said figure-8 peripheral shape of said strip and wherein said second domed member is coupled to said bottom half of said figure-8 peripheral shape of said strip, said bottom half of said figure-8 peripheral shape of said strip being positioned over said proximal portion of said cloth and said top half of said figure-8 peripheral shape of said strip being positioned over said central portion of said cloth;

a rib guard for protecting a rib area the a user, said rib guard comprising:

a generally rectangular cloth adapted to fit around a chest an upper torso of the user such that the lower ribs of the user are covered, said cloth having an upper surface and a bottom surface, said cloth having a first end and a second end, said upper surface of said first end having a hook and loop fastening structure thereon, said bottom surface of said second end having a hook and loop fastening structure thereon, wherein said cloth is wrapped around the torso of the user the top surface of the first end is covered by the bottom surface of the second end such that said ends are removably fastened together;

two protective shields, each of said shields being contoured to fit on a side area of said user adjacent to said user's lower ribs such that each of said shields being bowed outwardly away from said ribs;

two padded portions each having a perimeter size larger than one of said protective shields, each of said padded portions comprising elastomeric material; and a plurality of rivets for holding each of said shields to said rectangular cloth, wherein each of said padded portions is situated between one of said shields and said rectangular cloth, said rivets being positioned at spaced locations along and adjacent to a perimeter of each of said protective shields;

a hip guard for protecting a hip and thigh area of the user, said hip guard comprising:

a cloth adapted to wrap around the user's leg, said cloth having a circular portion and a rectangular portion, said rectangular portion having a first edge and a second edge, said first edge having three elongate cloth member extending therefrom, said elongate members having a bottom surface having a hook and loop structure affixed thereto, said second edge of said cloth having a hook and loop means affixed to an upper surface thereof, wherein placing each of the elongate members of the cloth over the second edge of cloth fastens said cloth to the user's leg;

a third domed member;

a fourth domed member, wherein a perimeter size of said fourth doomed member is smaller than a perimeter size third domed member;

two padded portions having a perimeter larger than said third and fourth domed member, each of said padded portions comprising elastomeric material; and a plurality of rivets adapted to fasten said strip between said cloth and said domed members, wherein said third domed member is coupled to said rectangular portion of said cloth and wherein said fourth domed member is coupled to said circular portion of said cloth, said rivets being positioned at spaced locations along and adjacent to a perimeter of each of said third and fourth domed members;

a calf guard for protecting a calf area of the user, said calf guard comprising:

a generally rectangular piece of cloth adapted to fit around the user's calf, said cloth having a first edge and a second edge, said first edge of cloth having two elongate members extending therefrom, each of said elongate members having a bottom surface having a hook and loop structure thereon, said second edge having a top surface having a hook and loop structure thereon, wherein placing said elongate members of said first edge over said second edge fastens said cloth to the user's calf;

a fifth domed member;

a padded portion having a perimeter larger than said fifth domed member, said padded portion comprising elastomeric material; and a plurality of rivets for fastening said fifth domed member to said cloth such that said padded portion is between said fifth doomed member and said cloth, said rivets being positioned at spaced locations along and adjacent to a perimeter of said fifth dome.

* * * * *